US010832551B2

(12) United States Patent
Wright et al.

(10) Patent No.: US 10,832,551 B2
(45) Date of Patent: Nov. 10, 2020

(54) SYSTEM AND METHOD FOR CHARACTERIZING AND PASSIVELY MONITORING A PROPERTY TO IDENTIFY EVENTS AFFECTING OCCUPANTS OF THE PROPERTY

(71) Applicant: Alert Labs Inc., Kitchener (CA)

(72) Inventors: Kevin Robertson Wright, Waterloo (CA); George Tsintzouras, Kitchener (CA)

(73) Assignee: Alert Labs Inc., Kitchener (CA)

( * ) Notice: Subject to any disclaimer, the term of this patent is extended or adjusted under 35 U.S.C. 154(b) by 0 days.

(21) Appl. No.: 16/115,509

(22) Filed: Aug. 28, 2018

(65) Prior Publication Data

US 2018/0365957 A1 Dec. 20, 2018

Related U.S. Application Data

(63) Continuation of application No. PCT/CA2017/050368, filed on Mar. 23, 2017.
(Continued)

(51) Int. Cl.
*G08B 21/04* (2006.01)
*G08B 19/00* (2006.01)

(52) U.S. Cl.
CPC ..... *G08B 21/0423* (2013.01); *G08B 19/00* (2013.01); *G08B 21/043* (2013.01);
(Continued)

(58) Field of Classification Search
CPC ..... G08B 1/00; G60Q 1/00; B60Q 1/00
See application file for complete search history.

(56) References Cited

U.S. PATENT DOCUMENTS

2005/0137465 A1 6/2005 Cuddihy et al.
2006/0055543 A1 3/2006 Ganesh et al.
(Continued)

FOREIGN PATENT DOCUMENTS

EP 2472487 A2 * 7/2012 ..... G08B 21/0423
EP 2472487 A2 7/2012
(Continued)

OTHER PUBLICATIONS

Halloran, B.; International Search Report from corresponding PCT Application No. PCT/CA2017/050368; search completed May 31, 2017.

*Primary Examiner* — Shirley Lu
(74) *Attorney, Agent, or Firm* — Brett J. Slaney; CPST Intellectual Property Inc.

(57) ABSTRACT

A system and method are provided for monitoring a property. The method includes analyzing data obtained from one or more sensor units deployed for monitoring the property to generate a signature of the property, the signature being indicative of normal activities associated with the property and/or one or more occupants of the property. The method also includes obtaining current data acquired by the one or more sensors; analyzing the current data against the signature for the property to determine whether or not the current data is associated with normal activity, abnormal activity, a lack of activity, or an actionable event for the property. The method also includes having an alert or notification sent in response to analyzing the current data when abnormal activity, lack of activity, or an actionable event is detected.

20 Claims, 11 Drawing Sheets

Related U.S. Application Data

(60) Provisional application No. 62/312,837, filed on Mar. 24, 2016.

(52) U.S. Cl.
CPC ..... *G08B 21/0453* (2013.01); *G08B 21/0469* (2013.01); *G08B 21/0476* (2013.01); *G08B 21/0484* (2013.01)

(56) References Cited

U.S. PATENT DOCUMENTS

| | | | | |
|---|---|---|---|---|
| 2006/0267780 | A1* | 11/2006 | Adams | A61B 5/1113 340/573.1 |
| 2014/0074504 | A1 | 3/2014 | Nelson et al. | |
| 2016/0171866 | A1* | 6/2016 | Dupasquier | G08B 21/0423 340/573.1 |
| 2018/0330591 | A1* | 11/2018 | Tilkin | H04N 7/18 |

FOREIGN PATENT DOCUMENTS

| | | | |
|---|---|---|---|
| GB | 2444107 | A | 5/2008 |
| WO | 2014173432 | A1 | 10/2014 |

* cited by examiner

SYSTEM AND METHOD FOR CHARACTERIZING AND PASSIVELY MONITORING A PROPERTY TO IDENTIFY EVENTS AFFECTING OCCUPANTS OF THE PROPERTY

CROSS-REFERENCE TO RELATED APPLICATION(S)

This application is a continuation of PCT Application No. PCT/CA2017/050368 filed on Mar. 23, 2017, which claims priority to U.S. Provisional Patent Application No. 62/312,837 filed on Mar. 24, 2016, both incorporated herein by reference.

TECHNICAL FIELD

The following relates to systems and methods for characterizing and passively monitoring a property, in particular to identify events or behaviours affecting or relevant to occupants of the property.

DESCRIPTION OF THE RELATED ART

There exist many people who are likely capable of and wanting to live independently, but for various reasons are considered or perceived to be at higher risk of life threatening events, such as accidents, heart attacks and strokes.

Services are in place in some areas, which allow for such people to receive regular visits from health and welfare agents. However, in several cases these services may be unavailable or unaffordable to some at-risk people.

The absence of such services then relies on close relatives or friends to make these visits, but that is dependent on the proximity, availability, and willingness of those individuals. Even when the services are available, it can still be several days or even weeks between visits, during which critical events may go unnoticed.

Solutions also exist to address these issues by providing "alert systems", which can be triggered by the person in the event of an emergency. These systems can be useful in some situations, but require that the device be worn at all times, and that the person remains conscious and coherent enough to use the device in the event of an emergency.

It is also possible to use modern video monitoring and/or audio recording equipment to remotely view the person at risk and ensure that they are well, but few people are known to choose such a system due to the loss of privacy and the requirement for someone to be actively monitoring the person remotely to ensure their health.

It is an object of the following to address at least one of the above disadvantages.

SUMMARY

A system and method are described herein, which can automatically detect events which require intervention and actively notify the appropriate individual or service provider, without unnecessarily or overly impeding on the privacy of the infirm.

The system and method are operable to characterize the "regular activity" within the environment of a monitored individual (e.g., an infirm person), and to actively notify individuals such as family or healthcare providers of events which fall outside of that regular activity.

In one aspect, there is provided a method of monitoring a property, the method comprising: analyzing data obtained from one or more sensor units deployed for monitoring the property to generate a signature of the property, the signature being indicative of normal activities associated with the property and/or one or more occupants of the property; obtaining current data acquired by the one or more sensors; analyzing the current data against the signature for the property to determine whether or not the current data is associated with normal activity, abnormal activity, a lack of activity, or an actionable event for the property; and having an alert or notification sent in response to analyzing the current data when abnormal activity, lack of activity, or an actionable event is detected.

In another aspect, there is provided a computer readable medium comprising computer executable instructions for performing the method.

In yet another aspect, there is provided a system comprising a processor, memory, and an interface for receiving data from sensor systems deployed in monitored properties, the system comprising computer executable instructions for performing the method.

In yet another aspect, there is provided a method of monitoring a property, the method comprising: analyzing data obtained from one or more sensor units deployed for monitoring the property to generate a signature of the property, the signature being indicative of normal activities associated with the property and/or one or more occupants of the property; providing the signature to a cloud-based system used to monitor the property; obtaining current data acquired by the one or more sensors; and sending the current data to the cloud-based system to have the cloud-based system analyze the current data against the signature for the property to determine whether or not the current data is associated with normal, abnormal, or a lack of activity at the property; and to have an alert or notification sent in response to analyzing the current data abnormal or lack of activity is detected.

In yet another aspect, there is provided a sensor system comprising one or more sensor units deployed for monitoring a property, a processor, and memory, the memory comprising computer executable instructions for performing the method above.

BRIEF DESCRIPTION OF THE DRAWINGS

Embodiments will now be described by way of example only with reference to the appended drawings wherein.

DETAILED DESCRIPTION

Figure 1:
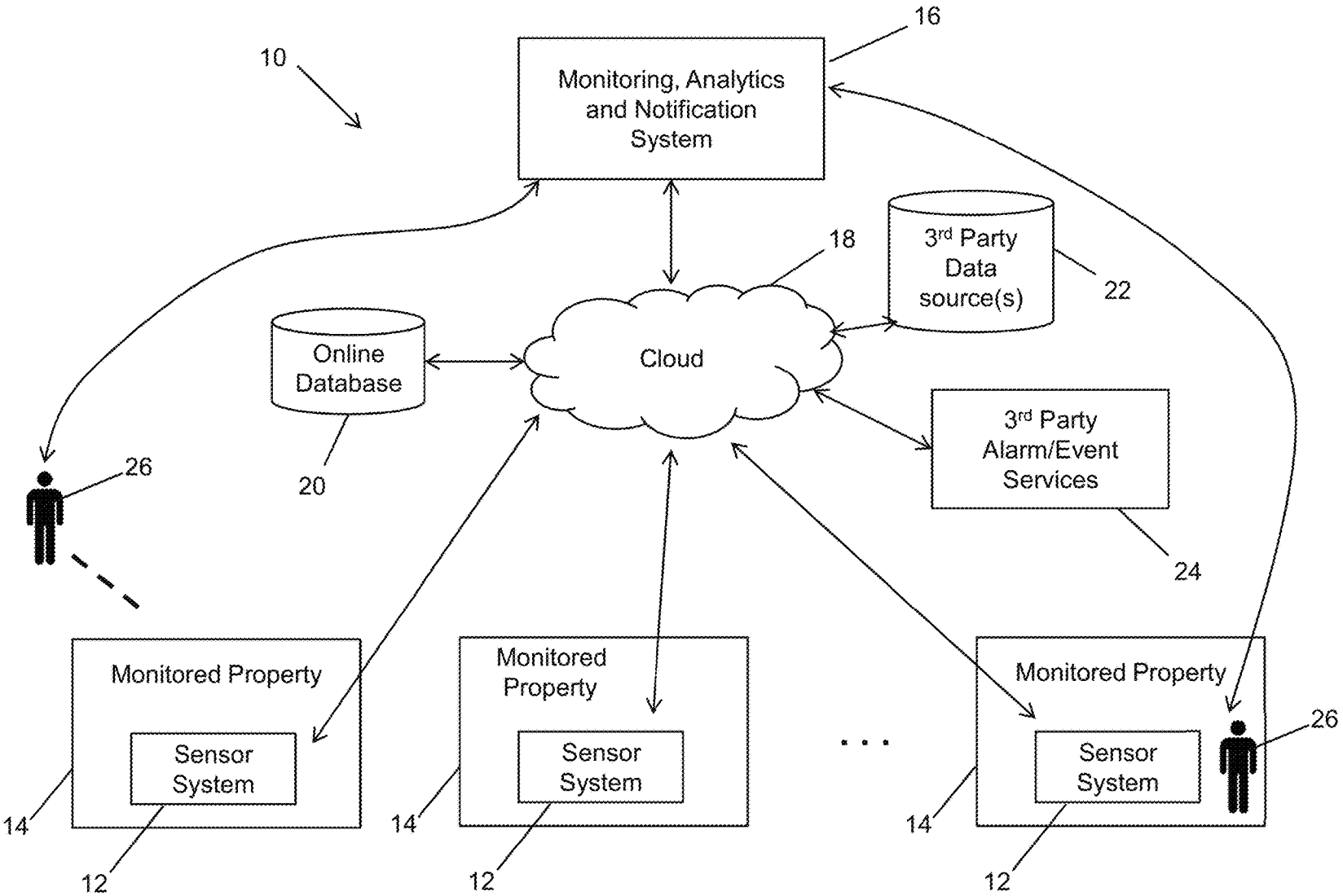
FIG. 1 is a schematic diagram of a system for monitoring properties.

The system described herein can monitor multiple aspects of an environment, in particular areas within (or an entire) dwelling such as a household. Aspects that may be monitored include, but are not limited to: temperature, water consumption, electricity or gas or other utility consumption, appliance or device usage, lighting, ambient noise, motion, ingress/egress to/from a building, air quality, etc.

The system can be operable to continuously analyze the environment to generate a model and signature that represents typical activity within the monitored property or portion thereof. This signature may then be used to identify unusual activities that may indicate situations which may require intervention. Thus, the system can measure multiple environmental aspects of the dwelling, and use this information to identify events requiring attention from interested individuals such as family, friends, health care providers, or monitoring services.

A passive health monitoring system is described in greater detail below as one particularly advantageous implementation, which includes a variety of sensors which run autonomously to generate a model of typical behavior in the home. Typical behavior that can be identified may include, but is not limited to, use of the toilet, bath or shower, turning electronic devices or lights on and off, use of the kitchen and others, opening of doors or windows, etc. Using an array of sensors around the home, a "fingerprint" or "signature", or other modeled output or indication of regular behavior can be determined, which is unique to the home and the resident(s) of that home.

This signature can be stored in a secure online database and may be used independently or in conjunction with 3$^{rd}$ party environmental data such as local weather to build a model of the home. Such a model of the home can include a single average model, or can include additional metrics such as seasons, days of the week, or to address other abnormal time periods such as vacations or holidays.

To address privacy concerns, the system can be operable to avoid directly discernible information of the home environment being made available to those monitoring the property, such as to family members or health care providers, without affecting the effectiveness of the system. For example, rather than flagging the use of the toilet or stove, the system can instead report at the metadata level informing subscribers of "normal activity", "abnormal activity", "lack of activity", "unusual events", etc. having been detected. Also, tracking audible alerts and alarms, rather than recording audio tracks in the home can avoid concerns with invasive monitoring. This ensures the privacy of the in0firm while providing actionable information to family and health care providers.

There are many reasons that typical behavior may vary, most of which are not critical, such as vacations, receiving visitors or other unusual events. In the event that unusual activity is detected, the activity may be automatically assessed for risk. Some events may have a high likelihood of requiring critical attention (unusual noise, continuous water flow) or less critical attention (lack of motion or irregular consumption of utilities) that may not trigger urgent attention, but may still be flagged for follow-up from either a family member or health care provider.

The system can be configured to notify one or more people in the case of a notable event detected by the system. Notifications could be accomplished through SMS, email, phone or other communication systems, performed automatically by the system as described below.

Turning now to the figures, FIG. 1 illustrates a system 10 for monitoring properties 14, each having one or more premises, for one or more users or entities. In FIG. 1 a sensor system 12 is deployed at each of a number of monitored properties 14, and is communicable within the system 12 to provide data to a monitoring, analytics and notification system 16 that is accessible from or otherwise on or within a cloud 18 or cloud-based service (hereinafter the "cloud or cloud-based system 16").

While the example configuration shown in FIG. 1 provides for a centralized service for many monitored properties 14 on behalf of many owners/operators/occupants, it can be appreciated that the system 10 can also be deployed in a closed system, e.g., for a commercial or industrial enterprise having multiple buildings or individual rooms (e.g., nursing home, hospital, retirement village, etc.) and a dedicated central system 16 that may or may not be accessible to that enterprise via the cloud 18. Moreover, some of the analytics can be performed by the sensor system 12 and the results of such analytics sent to the cloud-based system 16 for ongoing monitoring, alerts, etc. As such, it can be appreciated that the principles discussed herein can apply to various configurations to suit various applications.

In addition to the cloud-based system 16, an online database 20 can be provided for storing the data collected by the system 16. One or more 3$^{rd}$ party data sources 22 can also be accessed to obtain additional information such as weather, news, and other data that could impact the utilities being monitoring on the various premises. Similarly, one or more 3$^{rd}$ party alarm/event services 24 can also be accessed or fed into the system 16, e.g., services for tracking weather alerts, emergency conditions, earthquakes, air quality warnings, water quality warnings, etc. As illustrated in FIG. 1, a user 26 may access the cloud-based system 16 to view the data that is collected by its sensor system 12, and this may be done via an internet connection within the monitored property 14 (e.g., from a home computer) and/or from outside the monitored property 14 via a connection to the cloud (e.g., from a mobile device such as a smart phone or tablet with a cellular or WiFi connection). In this way, the users 26 of the system 16 can monitor their sensor units, certain properties 14, and occupants of those properties 14, from anywhere, at any time, and can be notified of events and alerts. It can be appreciated that the number and nature of such events and alerts can be dictated by the system 16 and/or can be tailored to each user, by way of user-accessible dashboards and portals as explained in greater detail below.

Figure 2:
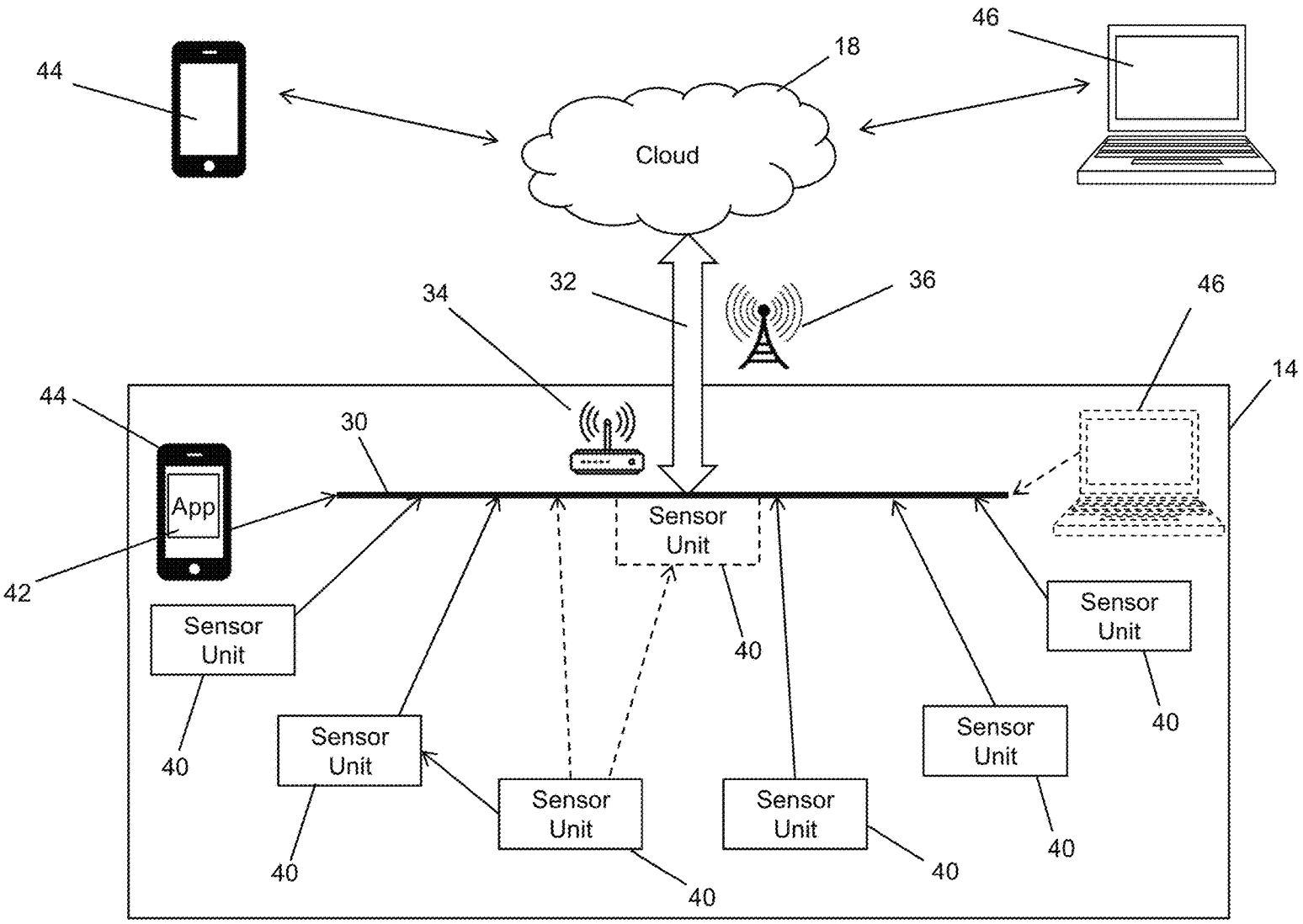
FIG. 2 is a schematic diagram of a monitored property.

FIG. 2 provides additional detail concerning a sensor system 12 deployed in a particular example of a monitored property 14 to illustrate a network of sensor units 40 that are used to passively gather data and monitor the property 14 and its occupant(s). While each sensor unit 40 can be independently operable and includes the software, hardware and mechanical attributes to interact with an aspect of the property 14 and gather data used for monitoring purposes; the sensor unit 40 needs to get the data it has gathered to the system 16 via the cloud 18. As illustrated in FIG. 2, this can be implemented by having a connectivity bridge or bus 30 such as a home network with a communication connection 32 to the cloud 18. Any available networking and connectivity protocol or paradigm is sufficient. For the sake of illustration, FIG. 2 illustrates a home network access point 34 such as a WiFi modem or router, and a cellular node 36 as example network connectivity mechanisms.

The communication connection 32 can be via a network 30 common to the sensor units 40 or, as illustrated in dashed lines, can be via a single master or "primary" sensor unit 40 that itself is responsible for accessing a home network or cellular network (or other available communication means) to relay data into the cloud 18. For example, other sensor units 40 deployed around the property for various purposes can each gather data and send that data to a primary sensor unit 40 to achieve connectivity to the cloud 18. Preferably, each sensor unit 40 has its own capability to connect into and through the communication connection 32. As such, it can be appreciated that various connectivity configurations are possible within the principles discussed herein.

In addition to standalone or purpose-built sensor units, existing devices and technologies can be used to track not only the property 14, but also the occupants. For example, an app 42 installed on a mobile device 44 such as a smart phone can be used to track activities, locations, and other information with respect to an occupant. Since such devices 44 are being more and more common for monitoring humans (e.g., fitness trackers, medical devices, etc.), such apps 42 can feed additional data into the cloud 18 for generating signatures of the properties 14 and occupant(s), and identifying normal and abnormal behaviour. As shown in FIG. 2, the mobile devices 44 and other computing devices 46 such as laptops, can be used within or outside the home by both occupants and/or caregivers to interact with the sensor units 40 or the backend systems and services in the cloud 18.

Figure 3B:
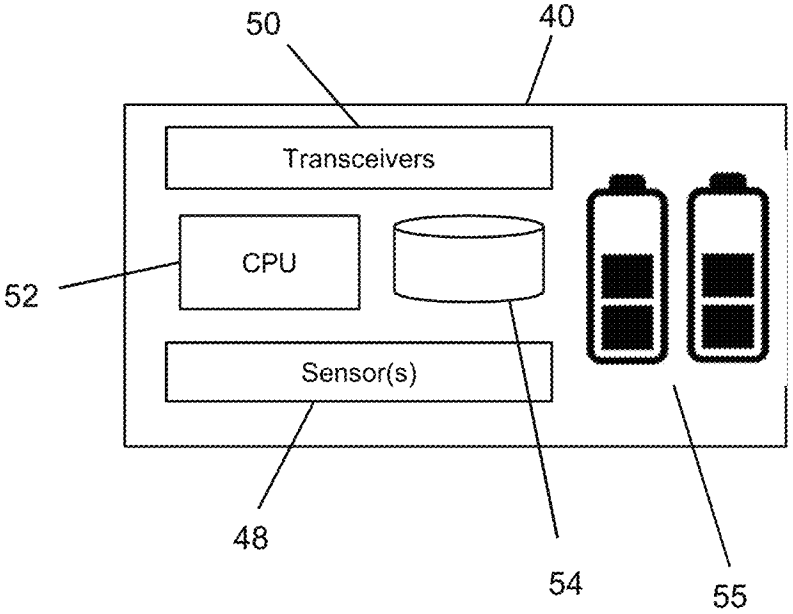
FIG. 3*b* is a schematic diagram of a sensor unit using battery power.
Figure 3A:
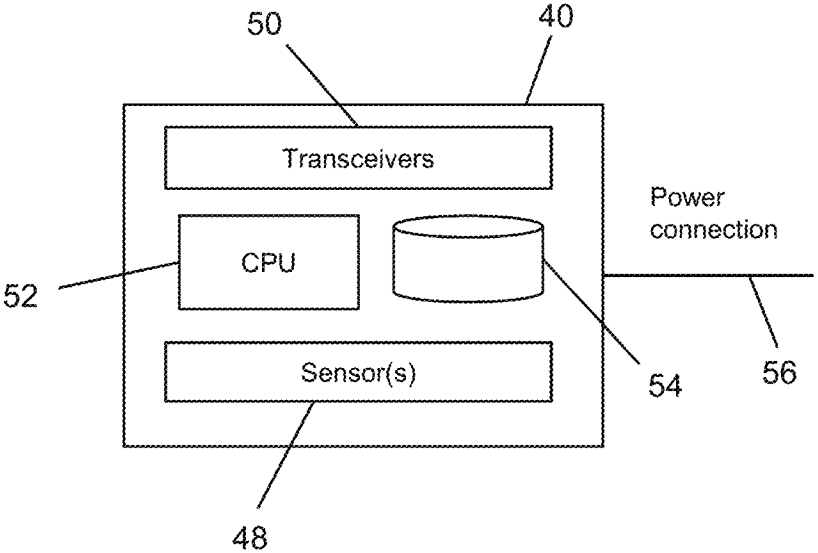
FIG. 3*a* is a schematic diagram of a sensor unit using an electrical power; connection.

In FIGS. 3*a* and 3*b*, a sensor unit 40 connected to a power outlet, and a sensor unit 40 relying on battery power are shown respectively. The sensor units 40, regardless of the source of power used, can each have a similar hardware architecture, deployed within a particular mechanical configuration that is easy to install and initiate monitoring of a particular device, utility, ambient condition, or output from a device. The similar hardware architecture, which is fully configurable and programmable for each application includes one or more sensors 48 for monitoring a particular aspect of the environment for which it is responsible (described in greater detail below), and optionally for monitoring additional environmental factors (i.e. over and above its primary responsibility/purpose) such as temperature, pressure, air quality, audible alerts from 3$^{rd}$ party devices such as smoke and/or CO detectors, etc. The architecture also includes one or more transceivers 50 to provide one or more of the communication capabilities discussed above. It can be appreciated that which transceivers 50 are provided can dictate whether that particular unit can or will operate as a primary (master) unit or a secondary (slave) unit (or either) for communicating data to the cloud 18. The architecture also includes a central processing unit (CPU) 52 or other data processing capability, at least one memory element 54, and a power source such as a connection to an electrical outlet 56 (FIG. 3*a*) and/or one or more batteries 55. It can be appreciated that this configurable architecture can be found in customized purpose-built sensor units 40 or be provided by or integrated with other existing devices such as smart phones, medical devices, wearables, monitoring equipment, etc. That is, the general architecture shown in FIGS. 3*a* and 3*b* is representative of general capabilities provided in order to obtain data, conduct some processing (if necessary), and get the acquired data in the cloud-based system 16 for monitoring, analytics, and alerts/notifications.

The transceivers 50, as noted above, are compatible within any existing or future network configuration that allows for at least one primary sensor unit 40 in the monitored property 14 to reach the cloud 18 via a long-range communication capability 32.

The set of secondary (slave) sensor units 40 are operable in a manner similar to the primary sensor units 40 in terms of monitoring and logging a respective activity, utility, device or appliance, but are distinguished from the primary sensor units 40 by relying on the long-range communication connection 32 of one or more primary sensor units 40. This is accomplished by providing a short-range communication capability in each secondary sensor unit 40 that is also provided in the primary sensor units 40 to enable short-range communications within the monitored property 14. For example, the primary and secondary sensor units 40 can be equipped with any available short-range radio that has a suitable range according to the expected distances between the primary and secondary sensor units 40. A suitable type of radio is a 915 mHz LoRA radio, which has a particularly long range and is particularly suitable for large properties such as multi-unit residential, commercial and industrial premises. It can be appreciated that other short-range communication connections such as Bluetooth are also possible. In other scenarios, as depicted in FIG. 2, an existing WiFi or other local area network can also be used as a primary or back-up communication capability for enabling the sensor units 40 to communicate within and outside the monitored property 14.

Figure 4:
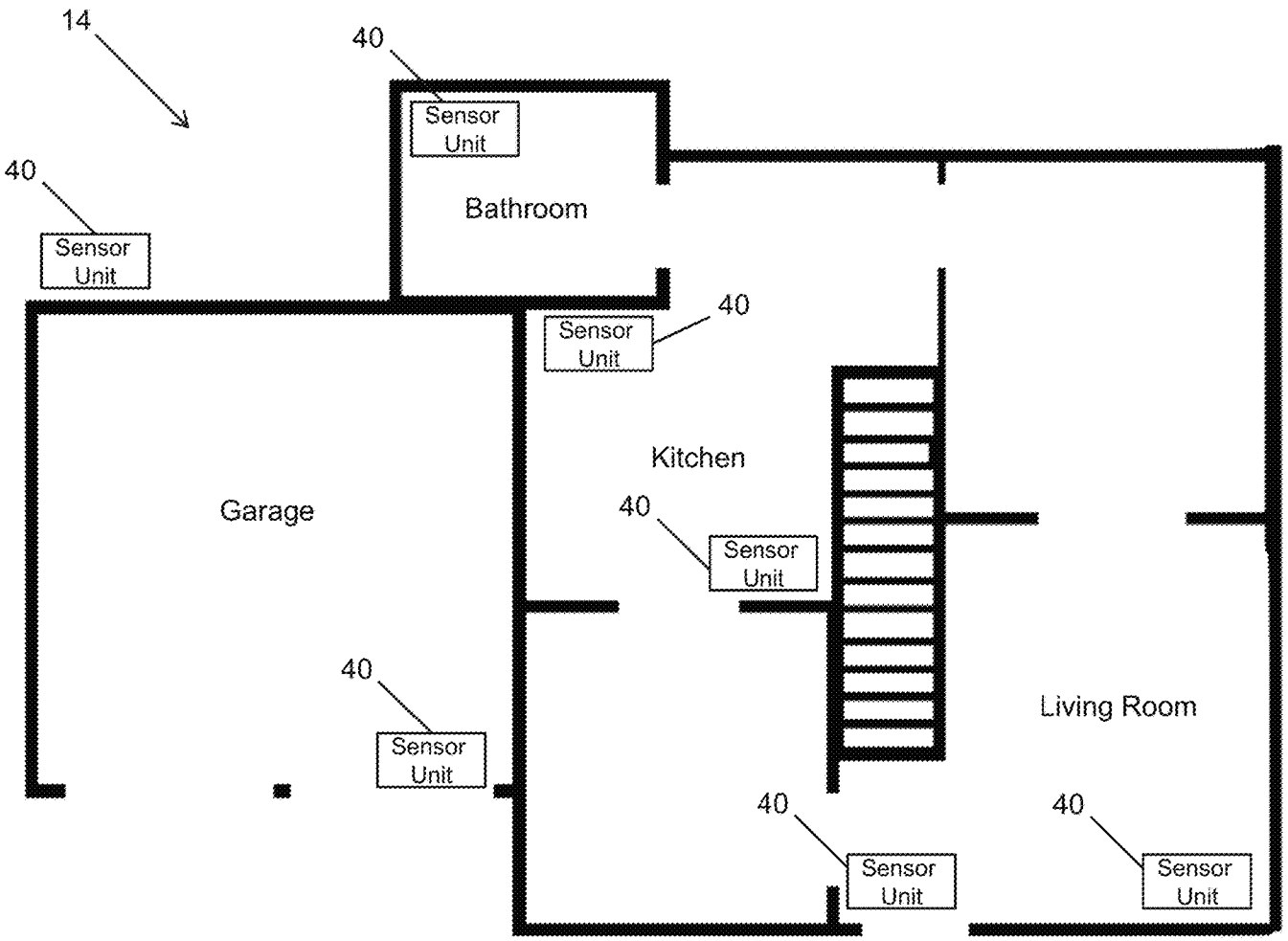
FIG. 4 is a schematic diagram of a property-wide monitoring system for an example dwelling.

As indicated above, each sensor unit 40 is deployed in a particular area of the monitored property 14 for a particular purpose. For example, in a household with an elderly or infirm occupant that is being monitored, different sensor units 40 can be arranged in locations within the home that are normally used by that occupant. This allows the sensor system 12 to be as simple or as complex as is necessary to properly model and determine a "signature" or "fingerprint" for the home and thus be able to assess normal activities of the home and its occupant(s). FIG. 4 illustrates an example of a home floor plan for a monitored home. A number of sensor units 40 are shown in FIG. 4 to provide a number of non-limiting examples for specific monitoring tasks and how collectively these can passively monitor the entire property 14.

Figure 5B:
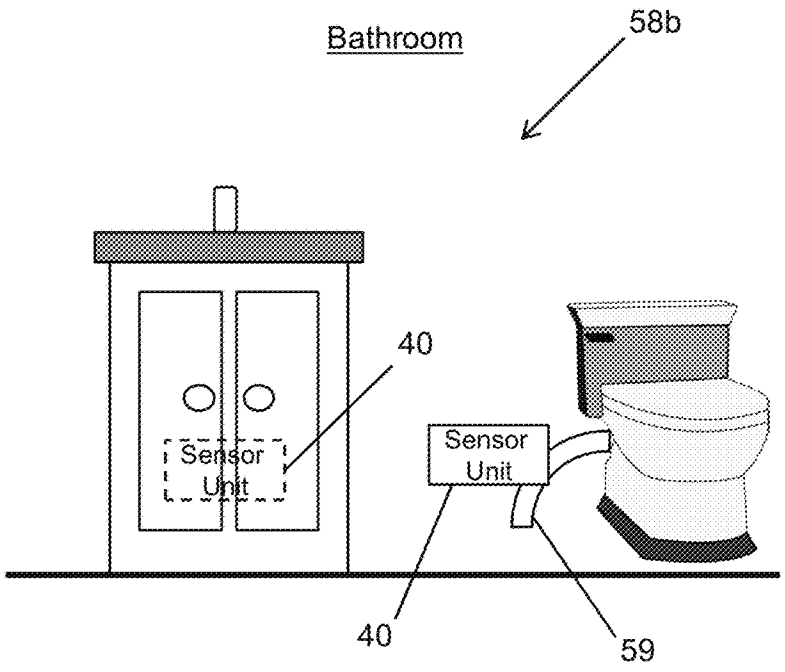
FIG. 5*b* is a pictorial elevation view of an example of a monitored bathroom in a monitored property.
Figure 5A:
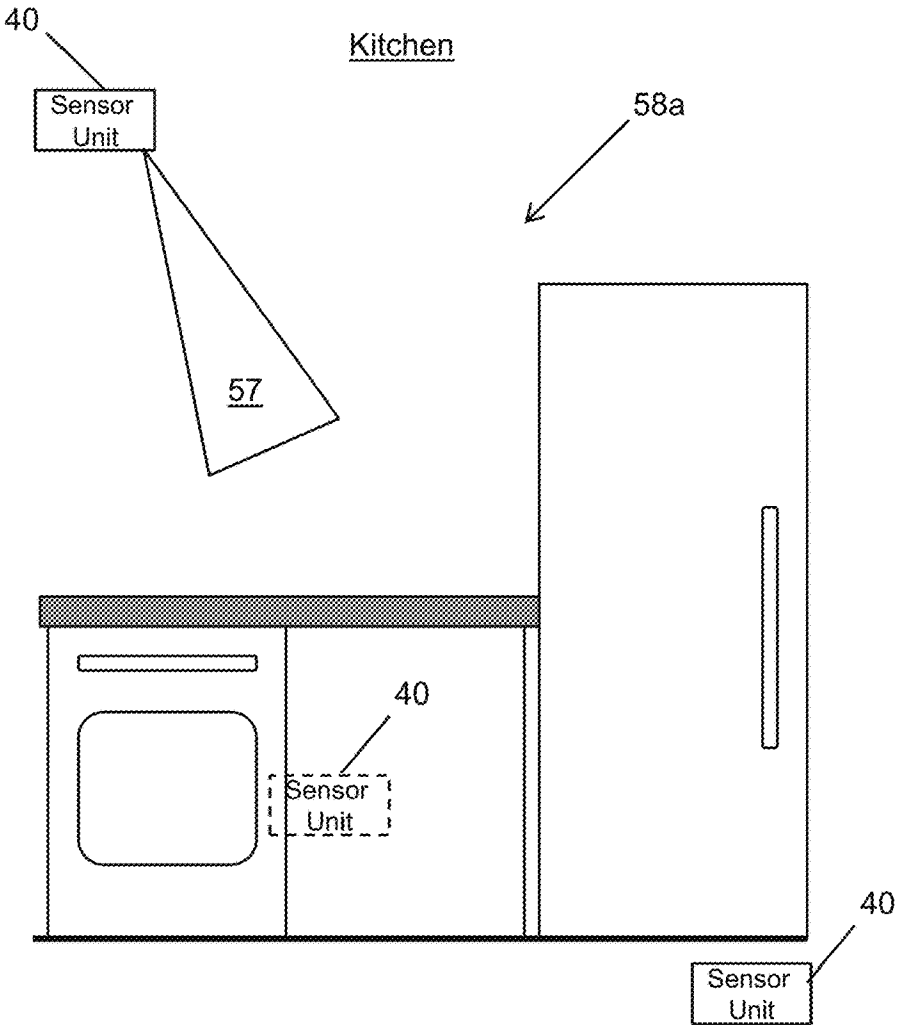
FIG. 5*a* is a pictorial elevation view of an example of a monitored kitchen in a monitored property.

In this example, the kitchen area includes two sensor units 40. This would allow, for instance, at least one sensor to monitor appliance or lighting usage, indicative of use of that room. Other sensors, such as motion sensors can be used to detect movement in and through the kitchen area. Additional sensors that can detect audible outputs, e.g., from smoke or CO detectors, timers, open door alerts, warm-up cycles, etc. Sensors tracking water flow, electricity or gas (or other utility) usage can also be placed in the kitchen. Any and/or all of these sensors can contribute at least some indication of not only usage in general, but particular types and patterns of usage. It can be appreciated that since each sensor unit 40 can include multiple sensors 48 (or sensor inputs), any one or more sensor units 40 can be deployed in order to monitor a particular area within the property 14. For example, as shown in FIG. 5*a*, a ceiling (or elevated) sensor unit 40 can be deployed to both track motion, and audible alerts, air quality, temperature, etc. Similarly, an under-the-counter sensor unit 40 can be used to detect multiple parameters, such as the opening and closing of an oven door (e.g., via a probe), water usage, drawer usage, etc. As also shown in FIG. 5*a*, a floor unit could be placed under an appliance such as a refrigerator to detect opening and closing of the door, as well as flood monitoring to track melting ice, leaking waterlines, etc. Whether or not the sensor units 40 are powered by an outlet or by a battery, and whether or not such sensor units 40 are primary units or secondary units can be configurable based on what is available or can be made available in the particular room.

A bathroom area, is also a common example of a room that is expected to have frequent usage and could be monitored to both establish normal activities, and detect normal activities. For instance, with normal usage of the bathroom 3-4 times per day, and a period of 24-48 hours with little to no usage could signify an abnormal situation that should be investigated. Similarly, frequent usage during nighttime hours could signal a potential issue. As shown in FIG. 4, one or more sensor units 40 can also be placed in a bathroom as part of a deployment at a monitored property 14. As also shown in FIG. 5*b*, a sensor unit 40 can be positioned under a sink or within a vanity to monitor water flow and usage of the sink, while another sensor unit 40 could be placed in proximity to a fill line for a toilet to determine usage of the toilet by tracking the number of times the tank is filled, and/or to detect a leaking or running unit that should be flagged. As with the kitchen example, in the bathroom, other sensors can be integrated into or feed data into the sensor units 40, such as air quality, temperature, audible alerts, lighting usage, motion, etc.

Returning to FIG. 4, various other sensor units 40 are shown in this example for illustrative purposes. For example, a sensor unit 40 can be placed at a front door to monitor ingress and egress from the monitored property 14. Such a sensor unit 40 could also monitor temperature, motion, audible signals such as a doorbell, etc. Another sensor unit 40 is shown in a living room, which could be used to monitor lighting usage, electronics usage, or other parameters indicative of normal activities within the monitored property.

A sensor unit 40 located in the garage can be used for entry detection, temperature monitoring, air quality (e.g., CO) monitoring, and motion detection. Such a sensor unit 40 is particularly useful for monitoring activities of a property 14 where the garage is used, either by the person being monitored, or healthcare providers. The temperature monitoring can also provide indications of a garage door being left open. Similarly, a sensor unit 40 can be positioned outside of the garage to monitor rear access entry. Such a sensor unit 40 could also be equipped with motion sensors for tracking activities in the rear yard (e.g., taking out garbage and recycling, watering gardens, and other activities performed by the monitored occupant).

Accordingly, it can be appreciated from the examples shown in FIGS. 4, 5*a*, and 5*b* that numerous deployment configurations can be implemented to suit the size and type of home, the rooms that are typically used, and the utilities, appliances, and devices that the particular occupant would normally use. By acquiring this data over time, and providing this data to the cloud-based system 16, a signature of normal activities can be established in order to detect abnormal activities and alert conditions on an ongoing basis.

Figure 6:
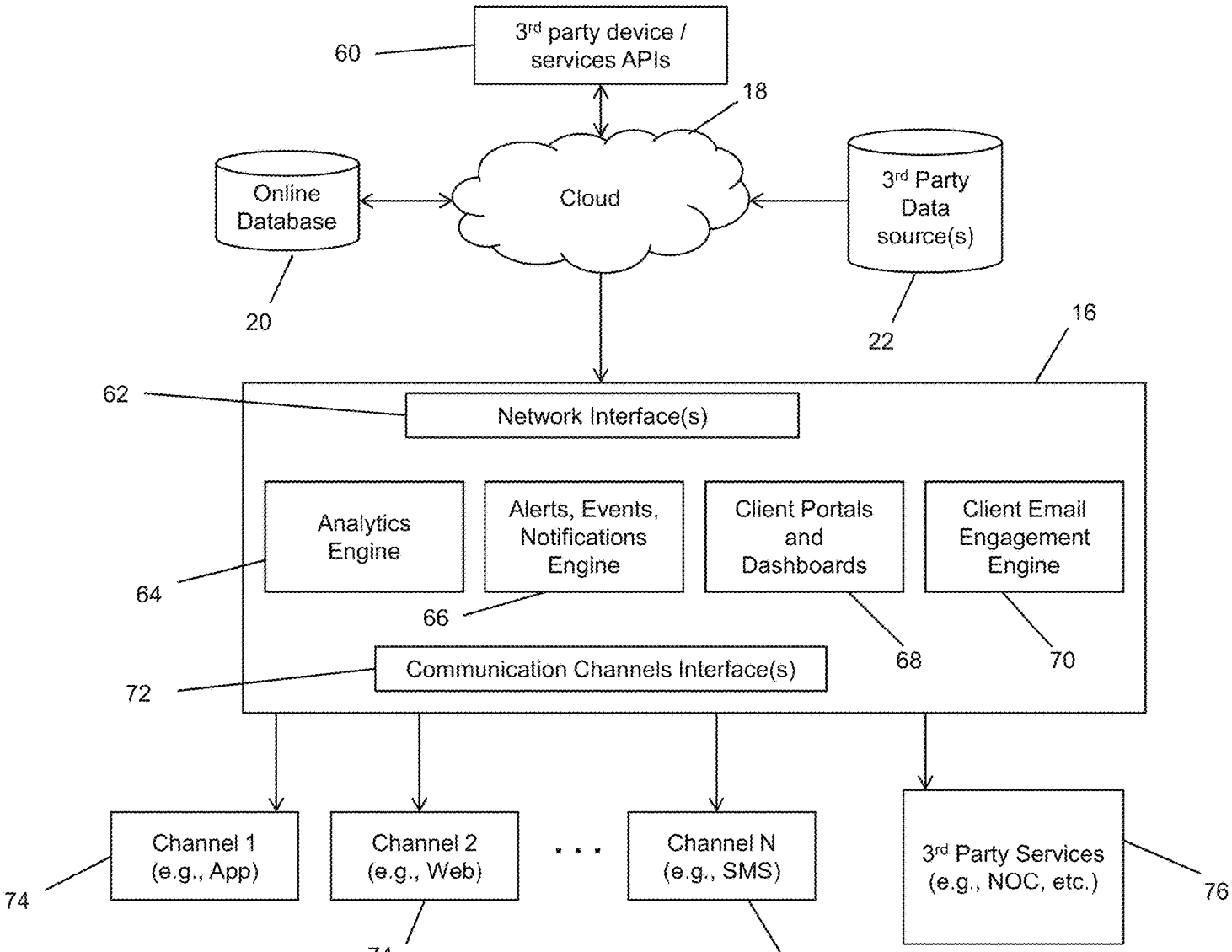
FIG. 6 is a schematic diagram of a cloud-based system for analyzing data obtained from monitored properties and providing notifications and alerts to registered user devices.

Further detail concerning the cloud-based system 16 is shown in FIG. 6. Turning now to FIG. 6, the cloud-based system 16 includes one or more network interfaces 62 that enable it to receive data from the sensor systems 12 via the cloud 18, and to interface with the online database 20, 3$^{rd}$ party data source(s) 22, and any other 3$^{rd}$ party device/service APIs 60 that have been provided to interact with 3$^{rd}$ party devices and services such as connected smart home devices, electronic personal assistants, home monitoring services, etc.

The cloud-based system 16 can be used to not only collect the data from the sensor systems 12 but also present, interpret, and act upon that data. For example, as shown in FIG. 6, the cloud-based system 16 can include an analytics engine 64 to perform analytics on both individual data for a particular client/customer, and pools of preferably anonymized data collected from many individuals and locations. In this way, the data that is collected can be interpreted in meaningful way to show usage trends, detect events, generate warnings, recommendations, or preventative health assurance or intervention tips, etc. An alerts, events, and notifications engine 66 is used to detect or be informed of detected events, and prepare suitable alerts and/or notifications. A client portals and dashboards module 68 is used to host and make available various portals and dashboards for interacting with the cloud-based system 16 (e.g., to register a device), and for viewing and interpreting the data that is collected (e.g., by viewing statistics, reports, recommendations, etc.). A client email engagement engine 70 is used to extract actionable information from the user's data, and provides an email-based output from the analytics engine 64. The cloud-based system 16 also includes one or more communication channel interfaces 72 for communicating with users via one or more channels 74, e.g., apps, web, SMS, email, etc. The communication interface(s) 72 also enable the cloud-based system 16 to interact with 3$^{rd}$ party services 76 such as network operating centers (NOCs) for allowing other systems to receive and act on conclusions drawn from the analytics engine 64. For example, a system that coordinates health care providers for one or more of the monitored properties 14 could interface with the cloud-based system 16 to determine when to schedule and coordinate visits based on information from the system 16. Such 3$^{rd}$ party services 76 can also be given a dashboard to allow them to review, analyze and act on the data generated by the system 16 for a particular entity or entities.

Figure 7:
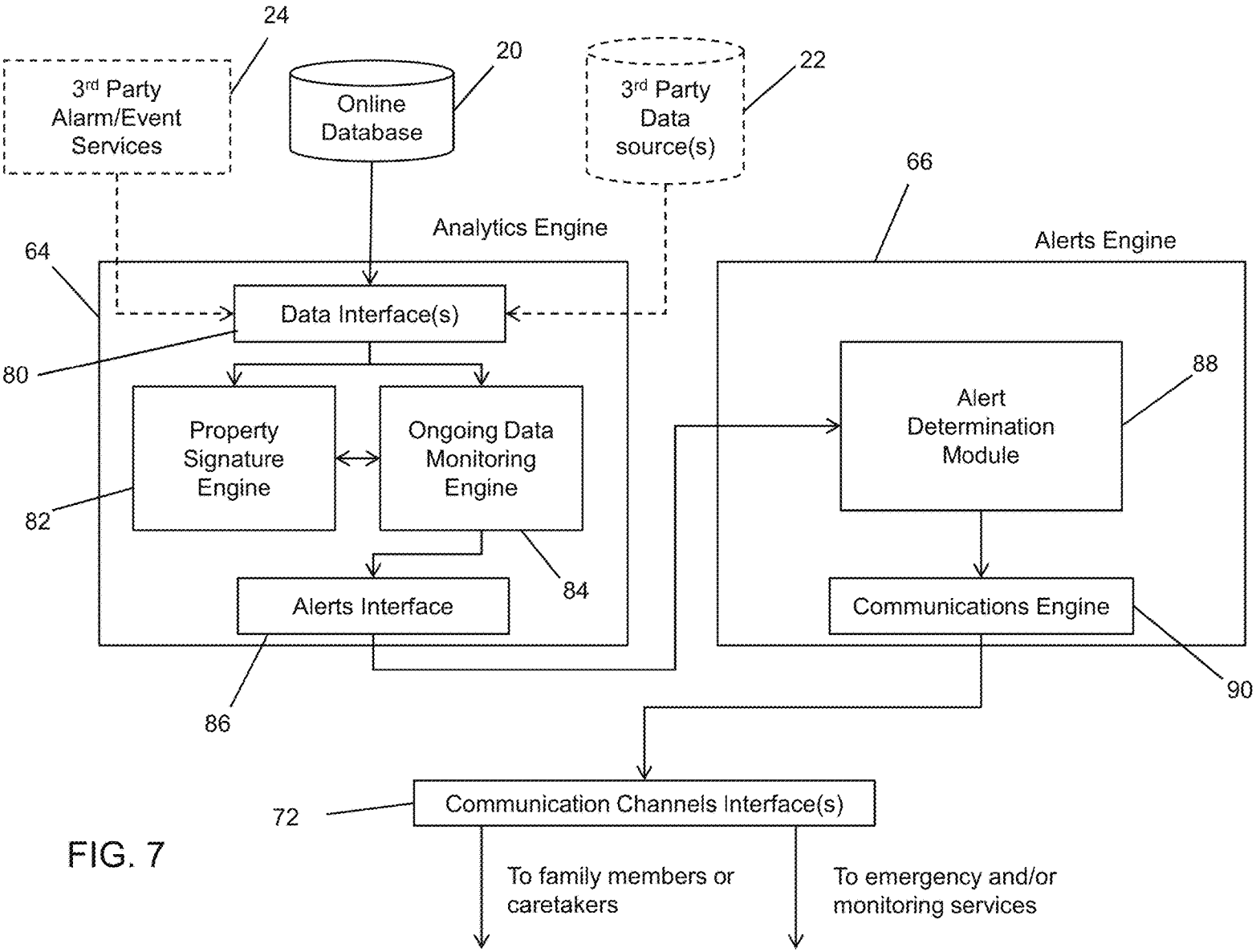
FIG. 7 is a schematic diagram of an analytics engine and an alerts engine for the cloud-based system shown in FIG. 6.

FIG. 7 schematically illustrates the collection and monitoring of data from the monitored properties 14 by the cloud-based system 16. In this example, data that is gathered from a particular monitored property 14 is assumed to have been stored in the online database 20 and via a data interface 80 is obtained by the analytics engine 64. Various other data and information can also be obtained from the 3$^{rd}$ party alarm/event services 24 and 3$^{rd}$ party data sources 22. The analytics engine 64 is used to both determine normal activities in order to determine a signature or fingerprint for the property 14, and to analyze ongoing activities to determine if abnormal activities have or are taking place, in order to enable alerts or notifications or reports to be generated. The data obtained through the data interface 80 can be provided to a property signature engine 82 to track historical data and establish patterns and trends about the usage of the property 14. For example, the data obtained may include daily water usage and lighting usage statistics indicative of normal usage of various rooms in the house. Normal temperatures and air quality readings, particular appliance usage, as well as ingress/egress events can also be tracked and recorded in historical logs. With enough data, or by beginning with manually entered baselines, the signature of that property can be established. Data that is obtained for properties that already have a signature associated with it, can be fed to both the signature engine 82 and an ongoing data monitoring engine 84 to compare the new data to the signature, and to refine and modify the signature over time if necessary. Based on the ongoing data monitoring activities, the ongoing data monitoring engine 84 can use an alerts interface 86 to provide flags, markers, or reports to the alerts engine 66 for determining whether or not to send an alert.

The alerts engine 66 in this example includes an alerts determination module 88 which is used to determine from the data provided by the analytics engine 64 whether or not the deviation from the signature warrants an urgent alert, a reminder, or becomes part of a periodic report or log. Either the ongoing data monitoring engine 84 or the alert determination module 88 can abstract or otherwise anonymize the data to ensure the privacy of the occupant(s) being monitored. For example, if the analytics engine 64 determines that the toilet has not been flushed in two days, rather than incorporating this specific occurrence into an alert, a deviation from the norm can instead be reported, with various levels of granularity as desired by the monitoring entity and the monitored occupant. The alert determination module 88 can provide alerts, notification, reports, etc. to the communication channel interface(s) 72 via a communications engine 90. It can be appreciated that the configuration shown in FIG. 7 is illustrative and various responsibilities described herein can just as readily be accomplished with more or fewer elements or modules. Similarly, the analytics and alerts engines 64, 66 could also be integrated into a single unit for conducting all analyses and determinations. Moreover, as noted above, some of the analytics can be performed "on-site" at the property 14, e.g., using one or more of the sensor units 14.

Figure 8:
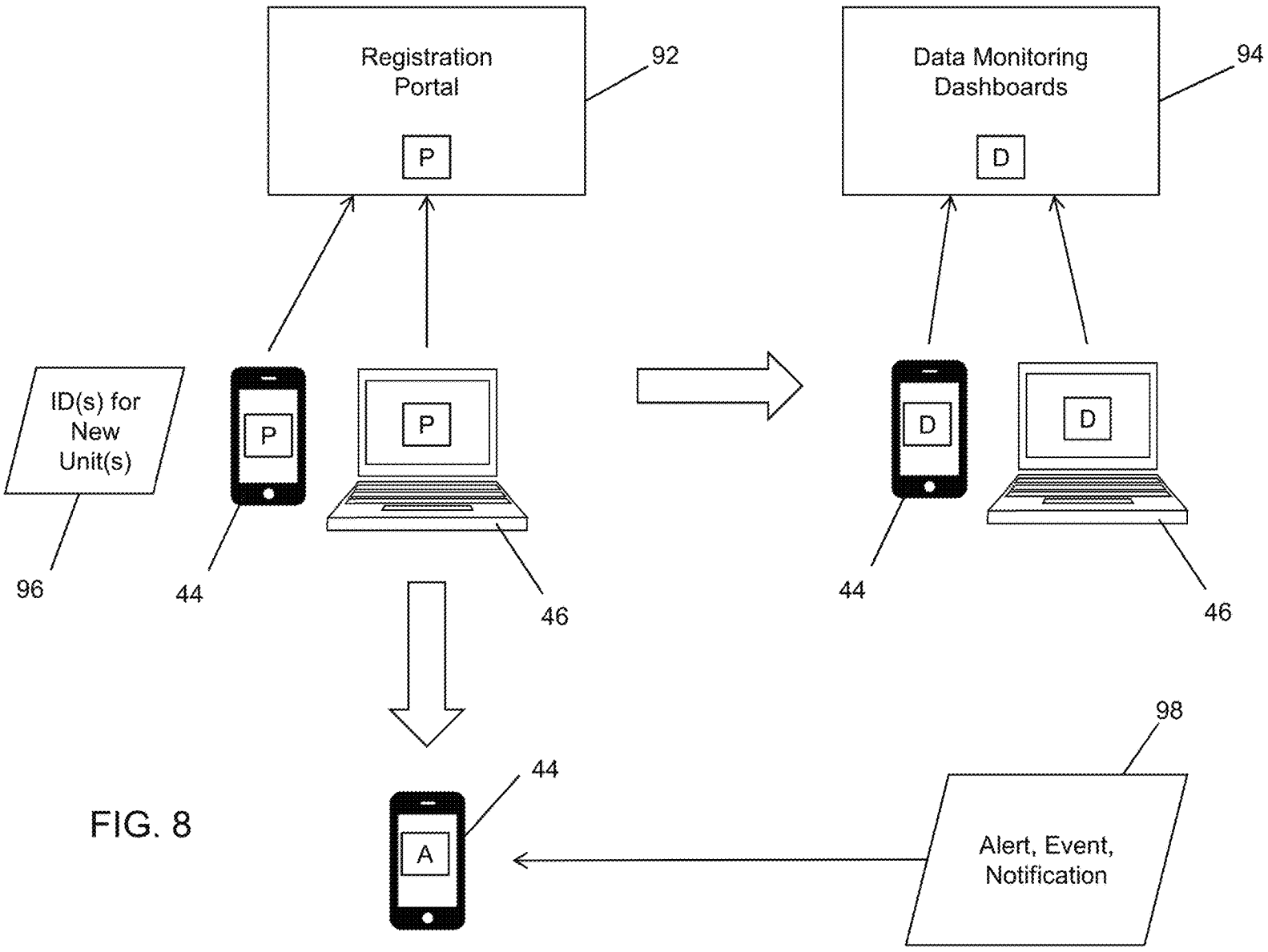
FIG. 8 is a schematic diagram of a user-device interacting with a registration portal, a data monitoring dashboard, and receiving an alert, event or notification.

FIG. 8 illustrates some example interactions between user devices 44, 46 and the cloud-based system 16. As indicated above, the cloud-based system 16 may require that the sensor units 40 be registered before being able to connect into the system 16. A registration portal 92 can be provided, which provides a user interface (e.g., hosted website P) that can be accessed using any internet connection. This allows the user or entity to register and create an account for that user or entity and to create profiles for one or more properties 14 that will be monitored. Once registered with the system 16, the user or entity can add sensor units 40 by providing unique identifiers (IDs) 96 that are associated with the units 40. In this way, the sensor units 40 can be programmed to automatically access, for example, a cellular network 36 and make itself know to the cloud-based system 16, and the IDs 96 matched to associate the logged data and events with the particular user or entity. As shown in FIG. 8, this can be done using a mobile device 44 or other computing device 46.

After registration, the cloud-based system 16 can provide data monitoring dashboards 94 for each registered user to allow that user or entity to view the data being collected by its devices. This allows, for example, home usage and occupant activity trends to be viewed and potentially remedial action taken according to the data observed. Other scenarios can be detected, such as abnormal or lack of activity for an occupant. Such dashboards D can be viewed and interacted with via a web-based interface or an app or widget, to allow any device 44, 46 with an internet connection to be used.

After registration of one or more sensor units 40, the user may also receive alerts 98 or other details concerning events or notifications that would necessitate a real-time or dedicated message. In this example, the alert 98 is sent to a mobile device 44, e.g., via an app or SMS message, but could also be sent via email to other electronic devices 46 such as a home or work PC.

Figure 9:
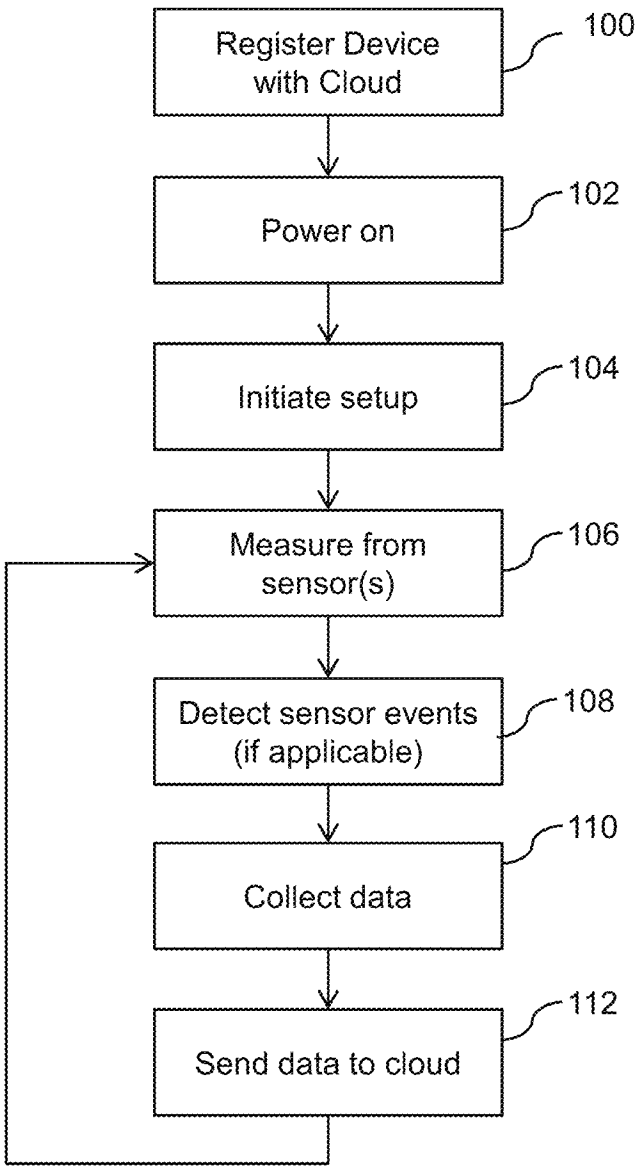
FIG. 9 is a flow chart illustrating computer executable operations performed in operating a passive sensor unit to monitor a property.

FIG. 9 provides a flow chart illustrating example computer executable operations that can be performed in gathering data from a sensor unit 40 and sending such data to the cloud-based system 16 via one or more connections to the cloud 18. At step 100, a sensor unit 40 is registered with the cloud-based system 16 to enable a cellular (or other long-range) connection to the cloud 18 to be established and for the cloud-based system 16 to be able to identify the particular sensor unit 40 and correlate or map it to its corresponding sensor system 12, owner, premises, etc. Between steps 100 and 102, it is assumed that the sensor unit 40 has been installed on the corresponding device or within the area of the property 14 that is being monitored. The sensor unit 40 may then be powered on at step 102. This may initiate an automatic or manual setup for the CPU 52 and sensors 48 at step 104, e.g., to detect and correct for ambient noise, to calibrate the sensor unit 40 according to characteristics of the device onto which the sensor unit 40 is installed (e.g., the strength of the rotating magnets in a water meter), etc. The sensor unit 40 then begins to obtain measurements from the one or more sensors 48 in the unit 40 at step 106. At step 108, the sensor unit 40 detects sensor events, if applicable at that time, and at step 110 collects data and sends that data to the cloud 18 at step 112.

Figure 10:
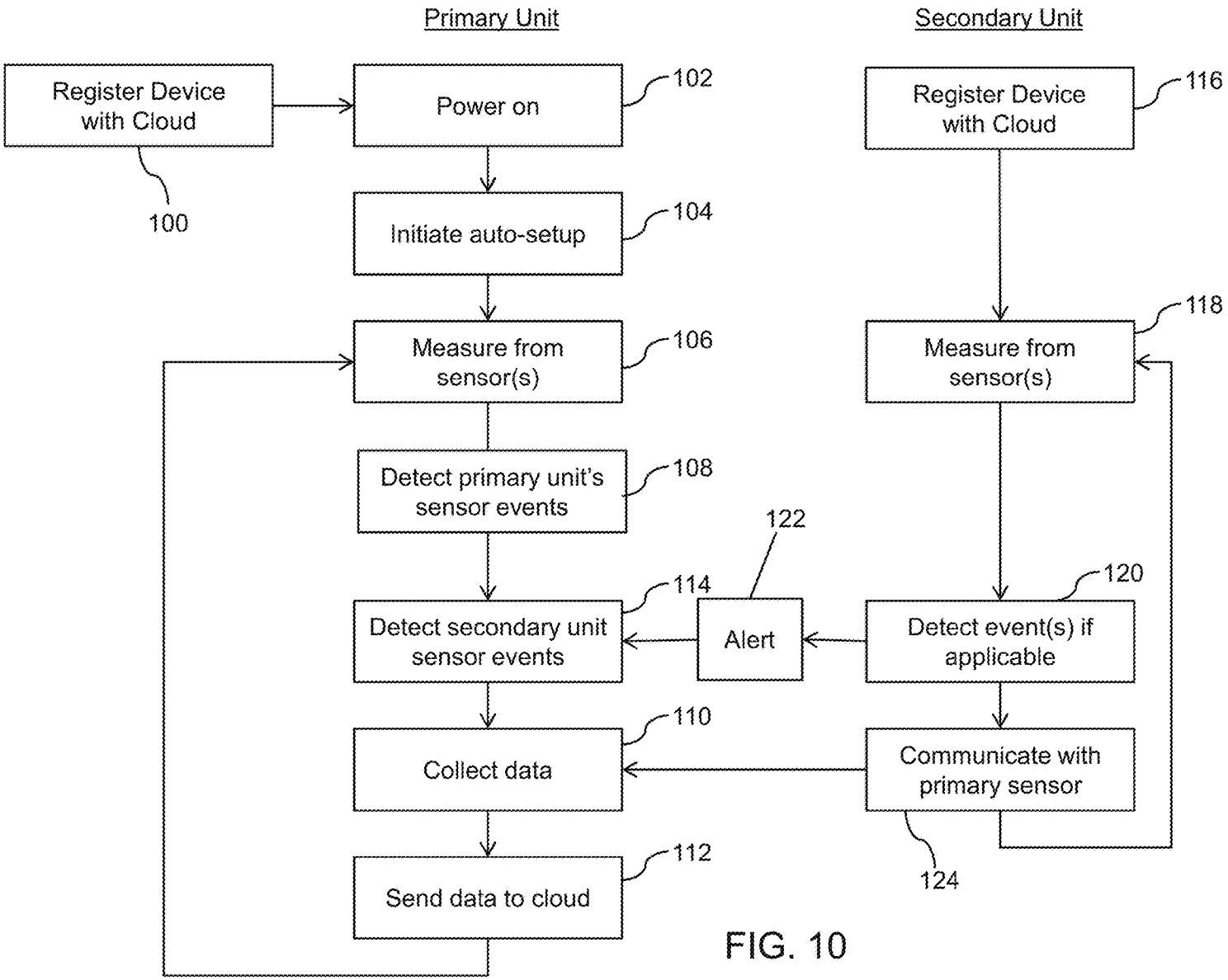
FIG. 10 is a flow chart illustrating computer executable operations performed in operating a system of primary and secondary passive sensor units to monitor a property.

FIG. 10 illustrates an example wherein a primary/secondary arrangement is used to get data from the secondary sensor unit 40 to the cloud-based system 16, via a primary sensor unit 40. Steps 102-112 are explained above and need not be repeated. After the primary sensor unit 40 is set up, and can receive and send data, one or more secondary sensor units 40 can also be registered with the cloud-based system 16 at step 116 and begin obtaining measurements from one or more sensors at step 118. For example, a flood detection secondary sensor unit 40 may be positioned on the floor of a basement or near a refrigerator or washing machine, and when provided with power can begin obtaining measurements from one or more sensors at step 118. For event-triggered devices such as a flood detection secondary unit 40, step 118 may simply include having a pair of contacts powered such that they are able to detect the presence of a fluid across the contacts and only detect an event at step 120 and report an alert 122 when that occurs. For secondary sensor units 40 that perform ongoing monitoring and logging, events may occur at various times for various reasons (e.g., a surge in electricity, a large increase or decrease in air temperature, etc.) and can be detected at step 120 and reported at step 122 at the appropriate time. Such secondary sensor units 40 may also communicate with a primary sensor unit 40 periodically at step 124, to provide the data that it has logged. That is, the secondary units 40 can be configured to report either or both alerts and logged data to a primary unit 40. The primary sensor unit 40 may therefore detect any sensor events being broadcast by a secondary unit 40 at step 114, by receiving one or more alerts 122 from the secondary unit 40.

The measurements taken by the primary unit 40 and received from the secondary unit(s) 40 are collected at step 110 and this data is sent to the cloud 18 at step 112, similar to what is shown in FIG. 9. It can be appreciated that the data can be sent in real-time as it is collected or periodically in chunks of data. Since primary sensor units 40 can be connected to the cloud 18 via a two-way connection, e.g., via a cellular network 36, the primary units 40 may optionally be pinged by the cloud-based system 16 in order to provide updates.

Figure 11:
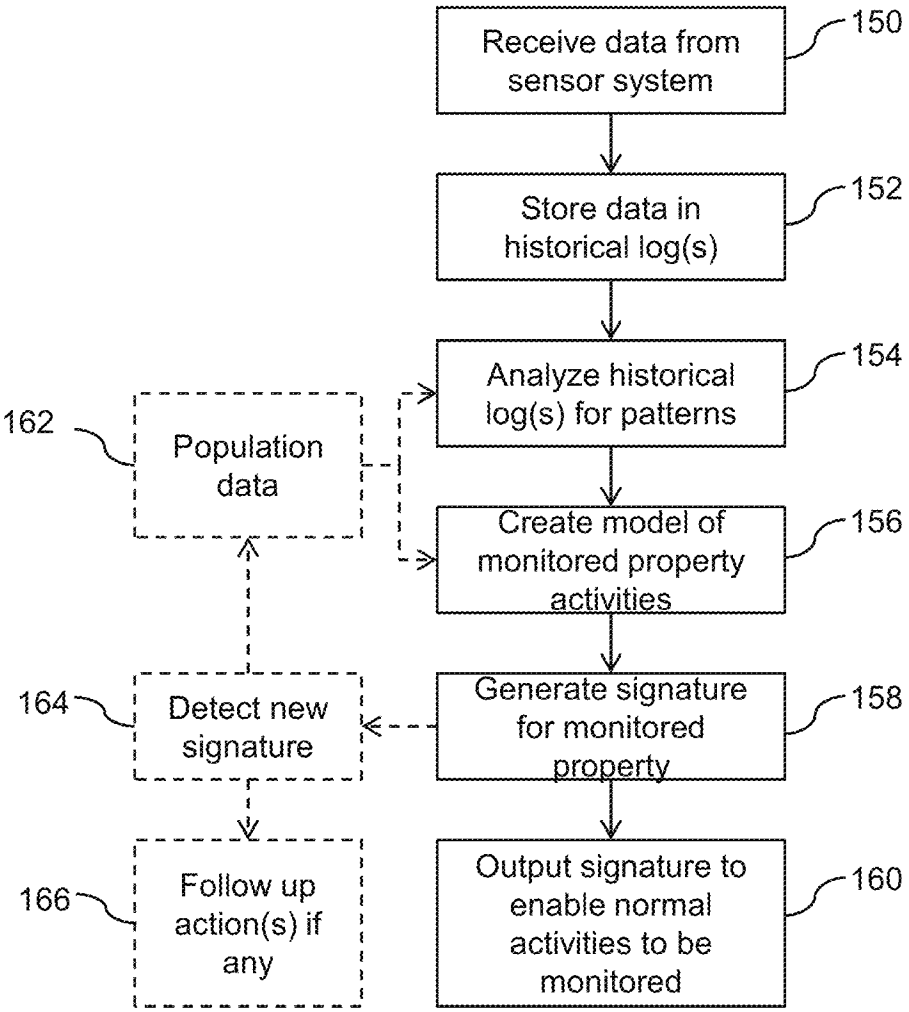
FIG. 11 is a flow chart illustrating computer executable operations performed in generating a signature of normal activity in a monitored property.

FIG. 11 illustrates steps that can be performed by the analytics engine 64, e.g., using the property signature engine 82, to generate a signature or fingerprint for a monitored property. At step 150, data is received from the sensor system 12 deployed at a particular monitored property 14, which can include data acquired by multiple sensor units 40 each having multiple sensors 48. The received data is then saved in one or more historical logs at step 152, e.g., in the online database 22. The data is then analyzed to determine patterns at step 154 that enable the creation of a model for the monitored property and its activities at step 156. Steps 154 and 156 can be enhanced by considering population data 162, namely data analyzed in other properties that can assist in generating the signature. That is, not only patterns of normal activities within a home can be used, but also what is typical in other homes. Based on the analyzing, the analytics engine 64 generates a signature for the monitored property 14 at step 158. The signature can include normal activities for certain days of the week, periods within each day, and further layers of granularity as desired.

The analytics engine 64 can also utilize artificial intelligence, machine learning, and/or other algorithmic tools to detect new and never before seen signatures at step 164, which allows the system 16 to continually evolve and determine what additional information it may need, or determine a follow-up action at step 166 (i.e. a decision as to what to do next).

The signature that is generated for that monitored property 14 is then output at step 160 to enable normal, abnormal, and lack of activity to be monitored against the signature.

Figure 12:
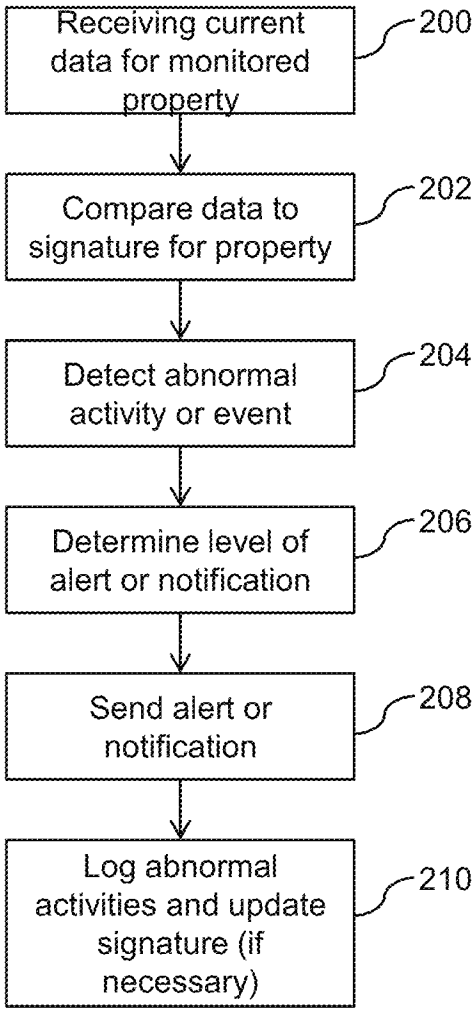
FIG. 12 is a flow chart illustrating computer executable operations performed in detecting an event and sending an alert from a cloud-based system.

FIG. 12 illustrates steps that can be performed on an ongoing basis to evaluate and provide alerts when necessary. At step 200 the analytics engine 64 receives current data for a monitored property, which can occur periodically or in real time or near real time. The data that is currently being evaluated is compared to the signature for the property 14 at step 202 to detect any abnormal activities or events at step 204. When this occurs, the analytics engine 64 can coordinate with the alerts engine 66 to determine a level for the alert or notification, e.g., to determine whether or not the caregiver or service or family member should be contacted immediately, whether or not emergency medical care is required, etc. The alert or notification is sent at step 208 using the determined format and channel appropriate for the condition, and the abnormal activity is logged at step 210 for establishing historical patterns, etc.

For simplicity and clarity of illustration, where considered appropriate, reference numerals may be repeated among the figures to indicate corresponding or analogous elements. In addition, numerous specific details are set forth in order to provide a thorough understanding of the examples described herein. However, it will be understood by those of ordinary skill in the art that the examples described herein may be practiced without these specific details. In other instances, well-known methods, procedures and components have not been described in detail so as not to obscure the examples described herein. Also, the description is not to be considered as limiting the scope of the examples described herein.

It will be appreciated that the examples and corresponding diagrams used herein are for illustrative purposes only. Different configurations and terminology can be used without departing from the principles expressed herein. For instance, components and modules can be added, deleted, modified, or arranged with differing connections without departing from these principles.

It will also be appreciated that any module or component exemplified herein that executes instructions may include or otherwise have access to computer readable media such as storage media, computer storage media, or data storage devices (removable and/or non-removable) such as, for example, magnetic disks, optical disks, or tape. Computer storage media may include volatile and non-volatile, removable and non-removable media implemented in any method or technology for storage of information, such as computer readable instructions, data structures, program modules, or other data. Examples of computer storage media include RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by an application, module, or both. Any such computer storage media may be part of the sensor units 40 or systems 10, 12, 16, any component of or related thereto, etc., or accessible or connectable thereto. Any application or module herein described may be implemented using computer readable/executable instructions that may be stored or otherwise held by such computer readable media.

The steps or operations in the flow charts and diagrams described herein are just for example. There may be many variations to these steps or operations without departing from the principles discussed above. For instance, the steps may be performed in a differing order, or steps may be added, deleted, or modified.

Although the above principles have been described with reference to certain specific examples, various modifications thereof will be apparent to those skilled in the art as outlined in the appended claims.

The invention claimed is:

1. A method of monitoring a property, the method comprising:

coupling each of a plurality of sensor units to elements in a property, the sensor units configured to generate sensor data indicative of variable characteristics of the elements, to directly monitor behavior of the property based on the sensed characteristics of the elements and independently of activities of the occupants of the property;

obtaining, by a monitoring system, historical sensor data for the property generated by the plurality of sensor units;

analyzing, by the monitoring system, the historical sensor data obtained from the plurality of sensor units to detect at least one pattern in the variable characteristics of the elements in the property and generate a unique signature of the behavior of the property based on the at least one pattern, the signature providing a baseline from which to determine when normal or abnormal activities associated with the property are detected from the sensor data to enable subsequent monitoring based on comparisons with the signature and without exposing the sensor data;

obtaining, by the monitoring system, current sensor data acquired by the plurality of sensors;

analyzing, by the monitoring system, the current sensor data against the signature for the property to detect a current behavior of the property and assign metadata specifying whether the current behavior of the property corresponds to normal activity, abnormal activity, a lack of activity, or an actionable event for the property; and sending, by the monitoring system, an alert or notification comprising the metadata without including the current sensor data acquired by the sensors to at least one entity monitoring the property to avoid directly discernible information of the property being made available to entities monitoring the property through the alert or notification.

2. The method of claim 1, further comprising sending the alert or notification, by the monitoring system, to an electronic device via one or more communication channels.

3. The method of claim 2, wherein the alert or notification provides an indication of abnormal activity, lack of activity, or an actionable event, without divulging specific activities associated with an individual.

4. The method of claim 1, wherein the signature is generated by modeling the historical sensor data collected from the property.

5. The method of claim 4, wherein the signature for the property is generated by further considering population data associated with a plurality of properties.

6. The method of claim 4, wherein the signature is updated over time as the current data continues to be gathered.

7. The method of claim 2, wherein the alert or notification is provided by or coordinated with a third party monitoring service.

8. The method of claim 7, wherein the third party monitoring service provides in-home healthcare related services for one or more monitored individuals.

9. The method of claim 2, wherein the alert or notification is provided to a family member or caregiver for one or more monitored individuals.

10. The method of claim 2, further comprising detecting a critical event, and providing an alert or notification to trigger an intervention or critical response.

11. The method of claim 4, wherein the signature for the property comprises an environmental model generated using the plurality of sensor units.

12. The method of claim 11, wherein the environmental model measures or identifies at least one of the following:

power consumption to automatically determine a difference between normal and abnormal consumption;

water consumption to automatically determine a difference between normal and abnormal consumption;

air temperature and/or quality to automatically determine a difference between normal and abnormal ambient conditions;

sound to automatically determine a difference between normal and abnormal measurements or to detect an alarm from another system;

hazardous conditions in the property.

13. The method of claim 12, wherein the hazardous conditions includes one or more of: floods, power outages, water leaks, or air quality issues.

14. The method of claim 1, further comprising using third party data to generate the signature of the property.

15. The method of claim 1, further comprising providing a registration portal for registering, at the monitoring system, the one or more sensors to the property.

16. The method of claim 1, further comprising providing, by the monitoring system, a dashboard to enable users to monitor the data acquired by the one or more sensors.

17. A non-transitory computer readable medium comprising computer executable instructions for monitoring a property, comprising instructions for:

coupling each of a plurality of sensor units to elements in a property, the sensor units configured to generate sensor data indicative of variable characteristics of the elements, to directly monitor behavior of the property based on the sensed characteristics of the elements and independently of activities of the occupants of the property;

obtaining, by a monitoring system, historical sensor data for the property generated by the plurality of sensor units;

analyzing, by the monitoring system, the historical sensor data obtained from the plurality of sensor units to detect at least one pattern in the variable characteristics of the elements in the property and generate a unique signature of the behavior of the property based on the at least one pattern, the signature providing a baseline from which to determine when normal or abnormal activities associated with the property are detected from the sensor data to enable subsequent monitoring based on comparisons with the signature and without exposing the sensor data;

obtaining, by the monitoring system, current sensor data acquired by the plurality of sensors;

analyzing, by the monitoring system, the current sensor data against the signature for the property to detect a current behavior of the property and assign metadata specifying whether the current behavior of the property corresponds to normal activity, abnormal activity, a lack of activity, or an actionable event for the property; and sending, by the monitoring system, an alert or notification comprising the metadata without including the current sensor data acquired by the sensors to at least one entity monitoring the property to avoid directly discernible information of the property being made available to entities monitoring the property through the alert or notification.

18. A monitoring system comprising a processor, memory, and an interface for receiving data from sensor systems deployed in monitored properties, the system comprising computer executable instructions for monitoring a property, comprising instructions for:

coupling each of a plurality of sensor units to elements in a property, the sensor units configured to generate sensor data indicative of variable characteristics of the elements, to directly monitor behavior of the property based on the sensed characteristics of the elements and independently of activities of the occupants of the property;

obtaining, by a monitoring system, historical sensor data for the property generated by the plurality of sensor units;

analyzing, by the monitoring system, the historical sensor data obtained from the plurality of sensor units to detect at least one pattern in the variable characteristics of the elements in the property and generate a unique signature of the behavior of the property based on the at least one pattern, the signature providing a baseline from which to determine when normal or abnormal activities associated with the property are detected from the sensor data to enable subsequent monitoring based on comparisons with the signature and without exposing the sensor data;

obtaining, by the monitoring system, current sensor data acquired by the plurality of sensors;

analyzing, by the monitoring system, the current sensor data against the signature for the property to detect a current behavior of the property and assign metadata indicative of specifying whether the current behavior of the property corresponds to normal activity, abnormal activity, a lack of activity, or an actionable event for the property; and sending, by the monitoring system, an alert or notification comprising the metadata without including the current sensor data acquired by the sensors to at least one entity monitoring the property to avoid directly discernible information of the property being made available to entities monitoring the property through the alert or notification.

19. A method of monitoring a property, the method comprising:

coupling each of a plurality of sensor units to elements in a property, the sensor units configured to generate sensor data indicative of variable characteristics of the elements, to directly monitor behavior of the property based on the sensed characteristics of the elements and independently of activities of the occupants of the property;

obtaining, by a local system, historical sensor data for the property generated by the plurality of sensor units;

analyzing, by the local system, the historical sensor data obtained from the plurality of sensor units to detect at least one pattern in the variable characteristics of the elements in the property and generate a unique signature of the behavior of the property based on the at least one pattern, the signature providing a baseline from which to determine when normal or abnormal activities associated with the property are detected from the sensor data to enable subsequent monitoring based on comparisons with the signature and without exposing the sensor data;

providing the signature, by the local system, to a cloud-based system used to monitor the property;

obtaining, by the local system, current sensor data acquired by the plurality of sensors; and sending the current sensor data, by the local system, to the cloud-based system to have the cloud-based system analyze the current sensor data against the signature for the property to detect a current behavior of the property and assign metadata specifying whether the current behavior of the property corresponds to normal activity, abnormal activity, a lack of activity, or an actionable event for the property; and to send an alert or notification comprising the metadata without including the current sensor data acquired by the sensors to at least one entity monitoring the property to avoid directly discernible information of the property being made available to entities monitoring the property through the alert or notification.

20. A sensor system comprising one or more sensor units deployed for monitoring a property, a processor, and memory, the memory comprising computer executable instructions for performing the method of claim 19.

* * * * *